US005235719A

United States Patent [19]

Wimberley

[11] Patent Number: 5,235,719

[45] Date of Patent: Aug. 17, 1993

[54] POWER RATCHET WRENCH ASSEMBLY

[76] Inventor: Leon Wimberley, P.O. Box 616, Camp Wood, Tex. 78833

[21] Appl. No.: 922,864

[22] Filed: Jul. 31, 1992

[51] Int. Cl.[5] ..... A47L 11/12

[52] U.S. Cl. ..... 15/236.01; 15/93.1; 30/169; 81/180.1

[58] Field of Search ..... 15/93.1, 236.01, 236.1; 30/169, 170; 51/57, 58, 68, 170 R, 170 MT, 170 TL, 181 R; 81/180.1, 181, 182

[56] References Cited

U.S. PATENT DOCUMENTS

| | | | |
|---|---|---|---|
| 1,657,229 | 1/1928 | Sferlazzo | 51/170 TL |
| 3,530,577 | 9/1970 | Franklin et al. | 51/170 MT |
| 4,255,828 | 3/1981 | Colla | 15/236.01 |
| 4,762,031 | 8/1988 | Bradley | 81/180.1 |
| 4,821,357 | 4/1989 | Millette | 15/93.1 |
| 5,038,478 | 8/1991 | Mezger et al. | 30/169 |
| 5,099,538 | 3/1992 | Galonnet | 15/93.1 |

*Primary Examiner*—Harvey C. Hornsby
*Assistant Examiner*—Mark Spisich
*Attorney, Agent, or Firm*—Gunn, Lee & Miller

[57] ABSTRACT

An assembly for converting the one-directional power transmission of a conventional power ratchet wrench into alternating transmission of the power to the wrench's driver head in both the clockwise and counter-clockwise direction without moving the rotational direction selected by the wrench's rotation direction selector subassembly from a first selected position. A scraper attachment attaches to the driver head of the wrench and an engagement arm connects the body of the attachment directly and tightly to the ratcheting section of the wrench. A scraper blade is pivotally connected to the body of the attachment and extends in a generally perpendicular direction from the axis of rotation of the body member. Operation of the wrench results in oscillating arcuate rotation of the scraper blade as it is pressed upon the surface to be scraped.

5 Claims, 2 Drawing Sheets

POWER RATCHET WRENCH ASSEMBLY

BACKGROUND OF THE INVENTION

The present invention relates to an assembly for converting the one-directional power transmission of a power ratchet wrench into alternating transmission of power in both clockwise and counter-clockwise directions. One embodiment of the tool is for scraping flat surfaces. More particularly the scraper tool of the present invention provides an oscillating actuated motion about a given axis. Even more specifically, the present invention is a specialized hand-held power tool for scraping flat surfaces such as gasket receiving surfaces of mating parts.

Existing scrapers are of three types. The traditional flat blade hand tool which has a handle along the same axis as the scraper blade. Pressure is applied to the handle in a forward moving direction and the flat blade, more particularly the scraping or cutting edge of the blade, rests against the surface to be scraped. As the cutting edge moves forward along the surface, a thin layer of material on the surface is removed. The operator may push forward or pull back slightly to engage and disengage the cutting edge from the leading edge of the cut to facilitate the removal of the thin layer. Generally, there is no side-to-side movement of the blade.

The second type of scraper is a power scraper which utilizes a reciprocating action, i.e., in and out, of a drive mechanism with a flat scraping blade affixed to the distal end of the driver. Again, the user applies a slight forward moving pressure to the handle of the drive, but the in and out reciprocating movement of the driver provides the cutting energy in the tool. There is no side-to-side or arcuated motion imputed to the cutting blade by the driver or the operator.

A third power-driven scraper utilizes a straight line reciprocating side-to-side motion and does not provide the arcuate movement provided by the present inventive scraper.

U.S. Pat. No. 3,604,520 (Shatto) teaches a power scraping tool with a blade having a ratchet means which prevents the work member and work blade from undergoing a return stroke. However, as will be seen, its operation is very different than the present invention.

U.S. Pat. No. 4,255,828 (Colla) shows the combination of a conventional socket wrench with a scraper attachment, but the operative scraping edge rotates about the same axis as the axis of the socket driver. Further the operative scraping edge of the attachment does not oscillate back and forth in an arcuate path as taught in the tool of the present invention.

Other power scraping tools are taught in U.S. Pat. No. 3,147,549; 3,377,702; and 4,413,412.

It has long been known that in using scrapers the cutting edge will jam or wedge into the flat surface being scraped or the material being removed. The operator will "wiggle" the tool slightly from side-to-side (left-to-right or right-to-left) in small arcs in order to free the cutting edge. Once freed the operator continues to stroke the tool forwardly to scrape the surface.

The scraper tool of the present invention provides a continuously oscillating arcuate movement of the blade as the tool is moved forward along the surface to be scraped. This arcuate movement is translated across a plane generally perpendicular to the axis of rotation of the driver head as held by the operator. Thus improved scraping efficiency is achieved with the present device.

Further, one embodiment of the scraper tool of the present invention may be adapted for attachment to a conventional power ratcheting tool for converting the tool into one that provides a continuous oscillation of the ratchet mechanism which is translated into arcuate movement of the cutting blade of the tool.

Although a most practical application of the present invention focuses on a scraper assembly, it should be understood that the present invention converts the one-directional power transmission of a power ratchet wrench into a unit in which power is alternatingly transmitted to the attachment to the wrench in both the clockwise and counter-clockwise directions without switching back and forth the direction selector switch or subassembly of the wrench. Any attachment to a conventional power ratchet wrench which may be benefitted by transmission of rotational power in both directions could be adapted to use the present invention.

The present invention provides a new, special scraper attachment to the traditional line of accessories in the powered, hand tool product line, without the need for the introduction or purchase of a new driver.

This new attachment may be effectively utilized by engine mechanics to quickly clean gasket surfaces in hard-to-reach areas where previous tools have been ineffective. The tool of the present invention may be adapted to be connected to poppet valve heads to provide small alternating clockwise and counter-clockwise rotation of the valve head in its seat for use in valve lapping operations.

Thus the assembly of the present invention provides a solution to long-standing problems in the powered, hand tool industry by providing a highly efficient oscillating scraper.

SUMMARY OF THE INVENTION

The invention is an assembly which converts the one-way transmission of power in a conventional power ratchet wrench into a wrench or unit in which power is alternatingly transmitted to an attachment to the wrench in both the clockwise and counterclockwise directions. Once the assembly is removed from the wrench, the wrench again operates in the conventional onedirectional power transmission mode. The placement of a scraper blade on the end of the assembly extending forwardly in a direction generally perpendicular to the axis of rotation of the assembly results in an improved and highly efficient scraper.

DETAILED DESCRIPTION OF THE PREFERRED EMBODIMENT

Figure 1:
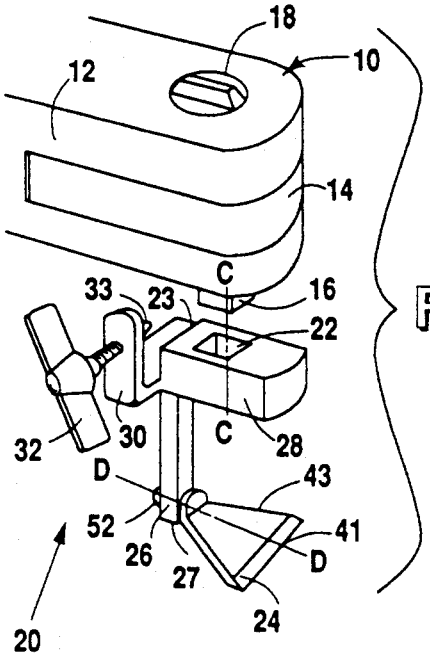
FIG. 1 illustrates a perspective view of one embodiment of the present invention disconnected from a power ratchet wrench.

FIG. 1 illustrates the conventional, air-powered ratchet wrench 10 with body member 12 and ratcheting section 14 and driver head 16 well known in the art. A ratchet direction selector switch or subassembly 18, well known with these devices, is shown. When the wrench 10 is activated, the driver head rotates about axis C in one direction only (for example, clockwise) depending upon the position of selector 18. The details of the operation of such ratcheting wrench is well known in the art.

In a manual ratchet wrench, the mechanic must move the wrench handle (not shown) in alternatingly clockwise then counterclockwise directions, but the driver head only rotates incrementally in the "engaged" direction. With the power wrench the mechanic simply attaches the wrench to the power source, generally an air pressure line, and pulls the "on" switch or lever thereby activating the ratcheting mechanism. The internal arrangement of the ratchet mechanism causes the driver head 16 to incrementally rotate in the "engage" direction.

The conventional, well-known, power ratchet mechanism generally has three major elements. The body section with notches or interdental spaces, the rotating bolt with two sets of ratchet pawls, and the selector assembly for selectively engaging either of the sets of ratchet pawls so as to permit motion in only one direction. In the power ratchet the rear end of the body section has a yoke which accepts a rotating crankshaft. It is the rotation of the crankshaft in the yoke which results in the body member moving first in a clockwise direction and then in a counter-clockwise direction. Whichever set of ratchet pawls is engaged with the interdental spaces or notches will determine the direction in which power is transmitted to the rotating bolt. Attachments are secured to the driver head of the rotating bolt. The operational or functional aspects of the standard power operated ratchet wrench are well known to one skilled in the art Normally, the speed of the incremental rotation of the driver head 16 in a power wrench is controlled by the operation of the activation lever. Thus, by way of the internal operation of the ratchet, the ratcheting section 14 of the wrench 10 oscillates rapidly in alternatingly clockwise and counter-clockwise directions. The mechanic does not move the wrench body (via the handle) in the alternatingly clockwise and counter-clockwise directions as is done with the manual ratchet wrench.

It should be well understood by one of ordinary skill in the art that affixing attachments to driver head 16 of the conventional ratchet wrench enables the operator to rotate the attachment in one direction depending upon the position of the selector switch 18. The attachment rotates in one direction about the axis of rotation of the driver head until the selector switch is changed.

One embodiment of the present invention illustrated in FIG. 1 shows a scraper attachment 20 with socket opening 22 (having a central axis C) in scraper head 28. Extending downwardly from the back side 23 of head 28 is leg member 26. Scraper blade 24 is pivotally attached to the distal end 27 of leg member 26. An upwardly extending L-shaped arm 30 has an engagement screw 32 for engagement with the ratcheting section 14 of wrench 10 as will be discussed below.

Blade 24 has an operative scraping edge or surface 41, a top face 43, and a bottom face 45. Pivotal movement, as well as retaining or securing the blade 24 in leg member 26 of the tool frame, is achieved by a locking screw 50 or the like which is adjustably engageable with a groove 53 cut into shaft 52. Groove 53 has a flat abutment surface 55 cut to limit the degree o rotation of blade 24. It should be noted that the operative cutting surface of blade 24 is generally in a plane perpendicular to the axis of rotation of the driver head 16. Blade 24 may pivot a few degrees about the axis of rotation D of the blade shaft 52; axis D being generally perpendicular to axis C.

Figure 2:
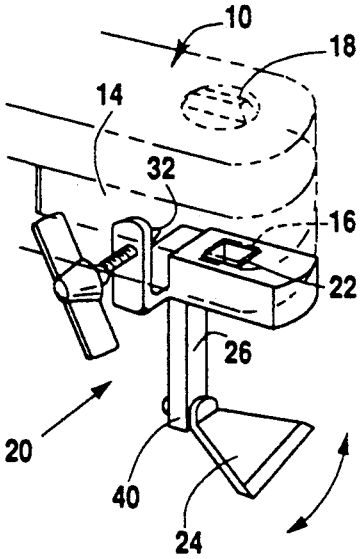
FIG. 2 illustrates a perspective view of one embodiment of the present invention connected to a power ratchet wrench.

FIG. 2 illustrates the scraper attachment 20 connected to the wrench 10. The male driver head 16 is engaged into socket opening 22 as is commonly known in the art. Engagement screw 32 is tightened for contact with ratcheting section 14. During operation of the wrench 10, screw head 33 remains tightly in contact with body section of ratchet section 14 during its alternating rotation in both the clockwise and counter-clockwise directions. This engagement of screw head 33 to section 14 is translated into the alternatingly clockwise/counter-clockwise rotation of attachment 20 because they have been in effect unitized as will be discussed below.

When the power wrench 10 is activated, the ratcheting section 14 rotates first in one direction and then the opposite direction in rapid succession. Driver head 16 is only powered to rotate in one direction, for example clockwise, depending on the position of selector 18. When ratcheting section 14 rotates back in the counter-clockwise direction during normal operation, driver head 16 does not rotate; the selected ratcheting pawls in the rotating bolt slide over the notches or interdental spaces (not shown) inside section 14 not rotating head 16. However, with the present invention, because engagement screw 32 is in tight contact with ratcheting section 14 at all times, attachment 20 effectively is unitized to section 14 and does rotate alternatingly in both the clockwise and counter-clockwise directions. This alternating rotation is translated through arm 30, to leg 26 and to blade 24. Thus the blade 24 is powered to alternatingly rotate in small arcs in the clockwise and counter-clockwise directions, with the position of selector 18 in the clockwise drive mode.

The operator pushes the wrench 10 forward with the blade 24 on the work surface applying a slight downward pressure vector. The blade 24 sweeps through small arcs improving the scraping operation. Because of the sweeping arcs of blade 24, considerably less effort is required in pushing the wrench both forwardly and downwardly. Because blade 24 is pivotally attached to leg 26 at pivot 40, slight angular adjustments may be made between the blade 24 and the wrench 10.

Figure 3:
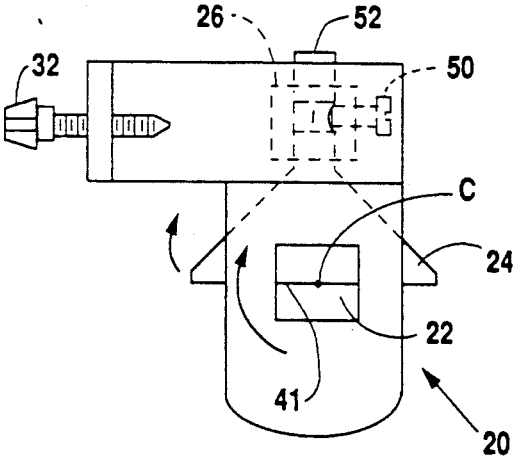
FIG. 3 illustrates a top plan view of the scraper attachment of the present invention.

FIG. 3 illustrates a top view of attachment 20. The leading or cutting edge 41 of blade 24 may be seen to align with the center axis C of the socket opening 22. Thus it may be observed that rotation about axis C translates into rotation or oscillation of the blade 24 not front-to-back or straight side-to-side reciprocating motion normally found with power scrapers. With engagement screw 32 operatively engaged with section 14, the slight oscillations of section 14 result in the cutting edge 41 of blade 24 moving through a small oscillating arc. It should be understood from FIG. 3 that the further the leading o cutting edge 41 is forward of the axis of rotation C, the greater the overall length of the arc of the blade (see FIG. 5).

It also should be understood from the foregoing description and the illustrations that the more the blade 24 is rotated about pivot 40 or axis D, the less overall arcuated movement there is in the cutting edge 41 of blade 24. In fact, if blade 24 were rotated to 90° about the axis D, the cutting edge 41 would not move through any arc. Best results are achieved when the angle of blade 24 is no greater than 45° from the horizontal.

Figure 4:
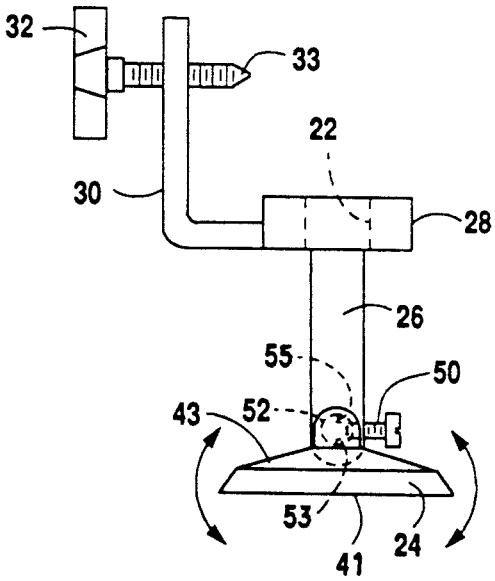
FIG. 4 illustrates a front elevation view of the scraper attachment of the present invention.

FIG. 4 shows how blade 24 is pivotally attached to leg 26 by shaft 52 so as to pivot about pivot point 40 for the slight angular adjustments of blade 24.

Figure 5:
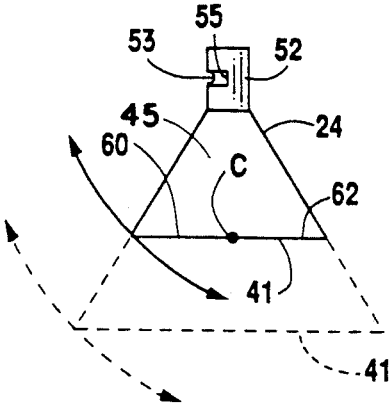
FIG. 5 illustrates a bottom view of the blade of the present invention showing the length of the arcs of rotation of the blade about axis of rotation C.

FIG. 5 illustrates how the overall length of the arc of rotation of blade 24 varies as the cutting edge 41 is moved further from the axis of rotation C. It may be understood that it is the impacting of outer cutting edges 60 and 62 in combination with forward hand pressure which effectuate the cutting action as the blade rotates back and forth.

Figure 6:
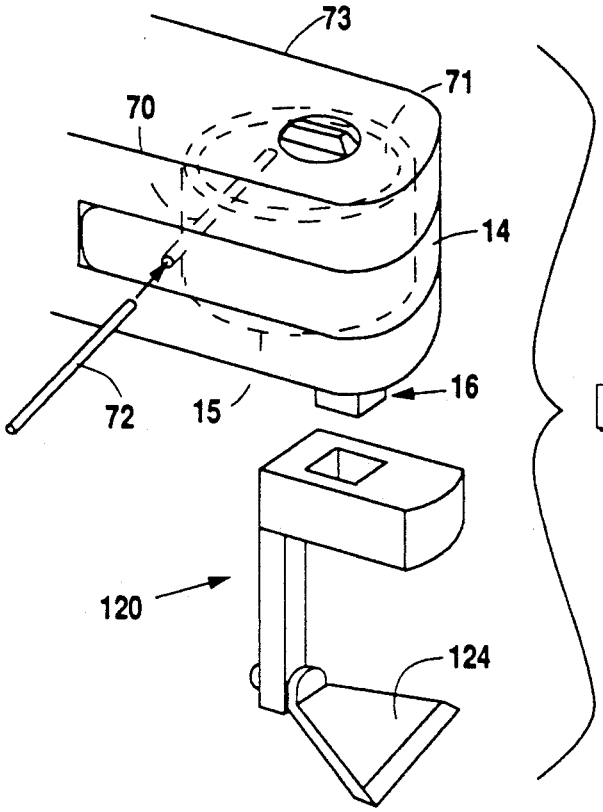
FIG. 6 illustrates an alternative embodiment of the present invention.

In an alternate embodiment of the present invention shown in FIG. 6, the attachment 120 may be connected to the wrench driver head 16 and the ratcheting section is pinned to result in the oscillating arcuations of blade 124.

A small bore 70 is drilled through the ratchet section 14. The bore passes through a first side 15 of the body of the ratchet section (which normally has the interdental spaces or notches), through the rotating bolt 71 (which has the ratchet pawls), and out the other side 73 of the body of the ratchet section. Thus the power operated wrench is modified to slidingly accept a locking pin 72. When the operator wishes to convert his conventional ratchet wrench to a wrench capable of producing the alternating rotation discussed above, he aligns the bore 70 in the wrench and inserts the locking pin 72 into the bore. Attachment 120 is connected to driver head 16, and the attachment will now oscillate as discussed above.

It should be understood further that the ratchet pawls in the rotating bolt may be modified during the wrench's manufacture to provide for the engagement of both sets of pawls simultaneously. Such modification may require the selector assembly to urge this simultaneous engagement when placed in a "locked" selector position. The modification of the pawls may include the splitting of the pawl body into two separate units with a set of springs urging the pawls into or out of engagement.

Figure 7:
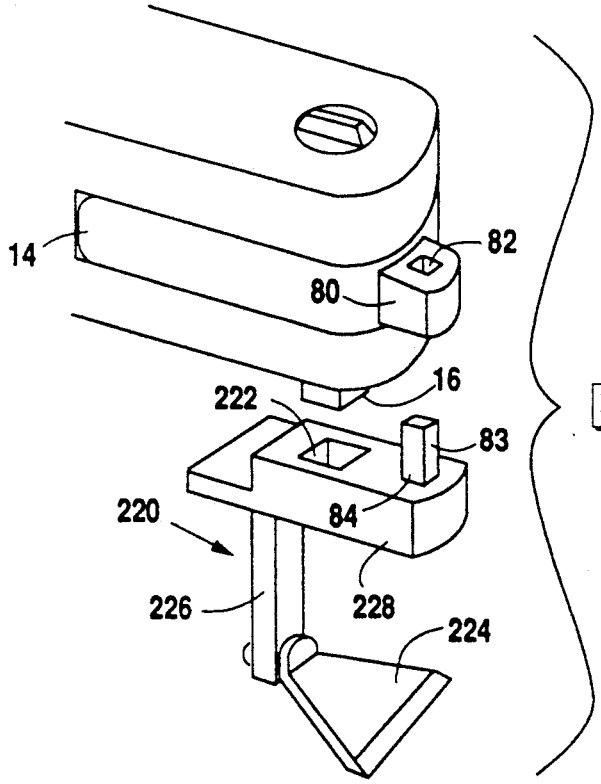
FIG. 7 illustrates yet another alternative embodiment of the present invention.

In FIG. 7 yet another embodiment of the present invention is shown. Here ratchet section 14 is adapted to have a lug member 80 rigidly attached thereto. Attachment 22O has a socket opening 222 in head 220. As previously discussed, extending downwardly from head 228 is leg 226. Scraper blade 28 is pivotally attached to the distal end of leg 226. A rigid engagement arm 84 extends upwardly from head 228. Lug 80 has a receiving orifice 82 extending therethrough which accepts the top end 83 of upwardly extending arm 84 when attachment 220 is connected to driver head 16. Thus in the embodiment of FIG. 7, again power is transmitted to attachment 20 during the clockwise and counter-clockwise alternating oscillation of ratchet section 14.

While the invention has been described in connection with a preferred embodiment, it is not intended to limit the invention to the particular form set forth, but, on the contrary, it is intended to cover alternatives, modifications, and equivalents, as may be included within the spirit and scope of the invention as defined by the appended claims.

I claim:

1. An assembly for attachment to a conventional power ratchet wrench having a rotation direction selector subassembly, a ratcheting member, a driver head and a wrench body comprising:

a body member;

an opening in said body member for releasably attaching said body member to said driver head;

means extending from said body member for directly linking said body member to said ratcheting member without said body member directly engaging said wrench body so as to translate power to said body member during clockwise and counterclockwise rotation of said ratcheting member when said rotation direction selector subassembly is in a first position and said conventional power ratchet is activated.

2. The assembly of claim 1 wherein said linking means further comprises:

an arm attached to and extending upwardly from said body member and adapted to contact said ratcheting member, said arm having a first end and a second end, said arm attached at said first end to said body member, said second end urgable against said ratcheting member.

3. The assembly of claim 1 further comprising:

a leg member attached to and extending generally vertically downwardly from said body member;

a scraping blade member pivotally attached to a distal end portion of said leg and extending generally perpendicularly from said leg.

4. A scraping tool for attachment to a conventional power ratchet wrench, said wrench having a rotation direction selector subassembly, a ratcheting member, a driver head and a wrench body comprising:

a body member;

an opening in said body member for attaching said body member to said driver head of said wrench;

means extending from said body member for directly linking said body member to said ratcheting member without said body member directly engaging said wrench body so as to translate power to said body member during clockwise and counter-clockwise rotation of said ratcheting member when said selector subassembly is in a first position and said conventional power ratchet is activated; and a scraper blade pivotally attached to said body member and extending generally perpendicular to and forward of the central axis of rotation of said opening in said body member.

5. A scraping tool for attachment to a conventional power ratchet wrench, said wrench having a rotation direction selector subassembly, a ratcheting member, a driver head and a wrench body comprising:

a body member;

an opening in said body member for releasably attaching said body member to said driver head;

an arm member extending from said body member for directly linking said body member to said ratcheting member without said body member directly engaging said wrench body so as to translate power to said body member during clockwise and counterclockwise rotation of said ratcheting member when said rotation direction selector subassembly is in a first position and said conventional power ratchet wrench is activated;

a leg member attached to and extending generally vertically downwardly from said body member;

a scraping blade member pivotally attached to a distal end portion of said leg and extending generally perpendicularly from said leg and generally perpendicularly to the central axis of said opening in said body member.

* * * * *